United States Patent [19]

Adams et al.

[11] 4,312,284

[45] Jan. 26, 1982

[54] NEEDLE BAR DEFLECTING ARRANGEMENT FOR A SKIP STITCH SEWING MACHINE

[75] Inventors: Kenneth D. Adams, Madison; Gerald J. Creed, Rahway, both of N.J.

[73] Assignee: The Singer Company, Stamford, Conn.

[21] Appl. No.: 212,384

[22] Filed: Dec. 3, 1980

[51] Int. Cl.[3] ..... D05B 3/02

[52] U.S. Cl. ..... 112/158 R; 112/221

[58] Field of Search ..... 112/158 R, 221, 79 R, 112/158 A, 167

[56] References Cited

U.S. PATENT DOCUMENTS

| | | | |
|---|---|---|---|
| 2,667,133 | 1/1954 | Court | 112/158 R |
| 3,559,601 | 2/1971 | Tullman | 112/158 R |
| 3,782,311 | 1/1974 | Adams et al. | 112/158 R |
| 3,815,532 | 6/1974 | Weisz et al. | 112/221 |
| 4,098,207 | 7/1978 | Peterson | 112/221 |
| 4,129,084 | 12/1978 | Kihara | 112/221 X |

FOREIGN PATENT DOCUMENTS

| | | |
|---|---|---|
| 1951799 | 10/1966 | Fed. Rep. of Germany . |
| 5221965 | 8/1975 | Japan . |

*Primary Examiner*—H. Hampton Hunter

*Attorney, Agent, or Firm*—William V. Ebs; Robert E. Smith; Edward L. Bell

[57] ABSTRACT

A skip stitch sewing machine is provided with adjustable means engageable with a camming surface on a needle bar for deflecting the needle bar when it is caused to descend while in an extreme lateral skip stitch position, and for thereby preventing a needle affixed to the lower end of the needle bar from striking a presser foot or throat plate.

9 Claims, 7 Drawing Figures

NEEDLE BAR DEFLECTING ARRANGEMENT FOR A SKIP STITCH SEWING MACHINE

DESCRIPTION

1. Field of the Invention

The invention is directed to a needle bar deflecting arrangement for use with a skip stitch mechanism in a sewing machine.

2. Description of the Prior Art

In a known type of skip stitch mechanism, as disclosed for example in U.S. Pat. No. 3,559,601 of Edward J. Tullman issued Feb. 2, 1971, a normally engaged needle bar latch comes into engagement with and is opened by a fixed bracket on a sewing machine frame whenever the needle bar is jogged by a gate to a predetermined maximum lateral position on one side of a central needle bar position. The needle bar is thereby disconnected from mechanism for imparting endwise reciprocatory motion thereto, and while disconnected from such actuating mechanism to provide for a skipped stitch, is held in an elevated position by the angularly extending arm of a cam in engagement with the latch. The cam is mounted on the unlatching bracket and can be adjusted into a position such as to urge the needle bar sufficiently to prevent a sewing needle from striking the presser foot or throat plate of the machine in the event the needle bar should fall past the cam arm.

In more recent skip stitch machines, the space consuming assembly of the aforesaid patent including a fixed unlatching bracket and attached cam has been replaced with a simple unlatching bracket adjustably attached to the needle gate, and a needle bar holding spring as shown in U.S. Pat. No. 3,782,311 of K. D. Adams et al for "Simplified Basting Stitch Mechanism" issued Jan. 1, 1974. However, the spring which was provided to hold the needle bar in an elevated position for skip stitching and prevent a needle from striking a presser foot or throat plate has proved to be insufficient by itself for the intended purpose. If the unlatching bracket has been misadjusted or becomes so by a loosening of the screws holding it to the needle bar gate, the bracket may fail to unlatch the needle from the endwise drive therefor. In such event, the needle bar, while in its lateral skip stitch position, may be moved downwardly against the bias of the spring until the needle engages the presser foot or throat plate and breaks into pieces some of which may fly in the direction of an operator inflicting injury upon him.

It is a prime object of the invention to provide an improved needle bar deflecting arrangement which can be used conveniently in association with skip stitch mechanism of the kind shown in U.S. Pat. No. 3,782,311 and which is effective to prevent the needle bar, when in a lateral skip stitch position, from moving a needle into an interferring relationship with a presser foot or throat plate.

It is another object of the invention to provide an improved needle bar deflecting and position limiting arrangement effective to prevent a needle bar which has been jogged beyond a maximum position for zig-zag stitching on either side of a central position from moving a needle into an interferring relationship with a presser foot or throat plate.

It is still another object of the invention to provide a ruggedly constructed durable needle bar deflecting arrangement suited to overcoming the null restoring forces of a servomechanism used to position the needle bar.

It is also an object of the invention to provide an improved needle bar deflecting arrangement which can be easily and economically incorporated in existing sewing machine structures.

Other objects and advantages of the invention will become apparent during a reading of the specification taken in connection with the accompanying drawings.

SUMMARY OF THE INVENTION

The needle bar of a skip stitch sewing machine of the kind described is provided with an elongated recessed section which in an up position of the needle bar, extends both upwardly and downwardly with respect to a lower gate supporting arm of a support bracket for head end mechanism. The lower gate supporting arm is fitted with a screw which extends into a slot in the arm wherein the needle bar is movable laterally as well as up and down. The screw is aligned with the recessed section of the needle bar and is adjustable to a position wherein it is effective to engage a camming surface on the recessed area of the needle bar whenever such needle bar is caused to descend while in a skip stitch position on one side of a central needle bar position. The needle bar is then deflected by the engagement of the screw and camming surface toward its central position, and the sewing needle is thereby prevented from striking a presser foot or throat plate. A second screw is provided in the lower gate supporting arm as a stop to prevent the needle bar from being jogged beyond a position on the opposite side of its central position from the skip stitch position resulting in interference of the needle with the presser foot and throat plate.

DESCRIPTION OF THE PREFERRED EMBODIMENT

Figure 1:
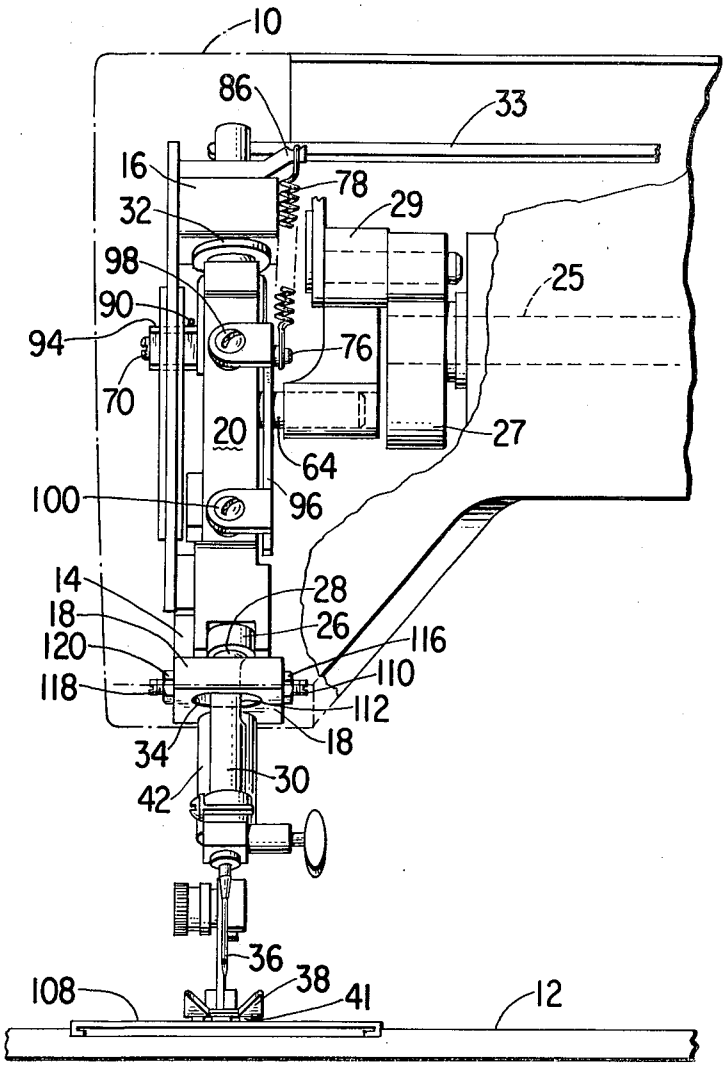
FIG. 1 is a front elevational view of the head end portion of a sewing machine incorporating the invention.
Figure 2:
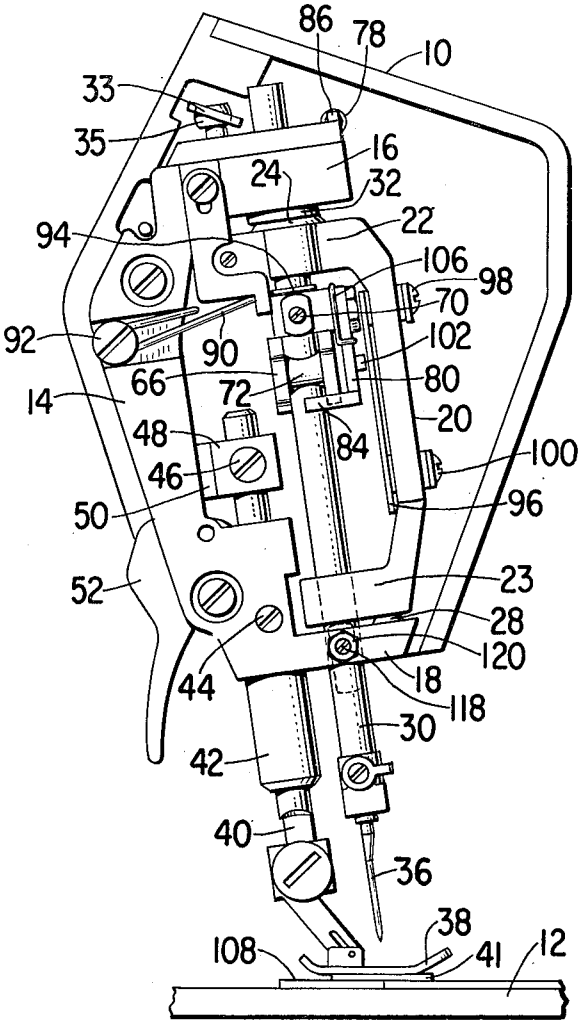
FIG. 2 is an end elevational view of the head end portion of the machine from which the end cover and an end face plate have been removed.
Figure 5:
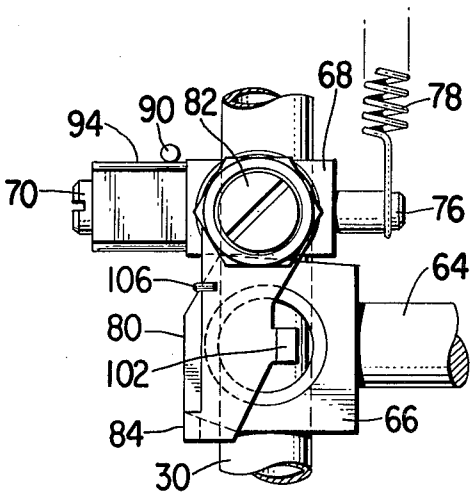
FIG. 5 is a front elevational view of the latch mechanism shown connected to the reciprocating drive means.
Figure 4:
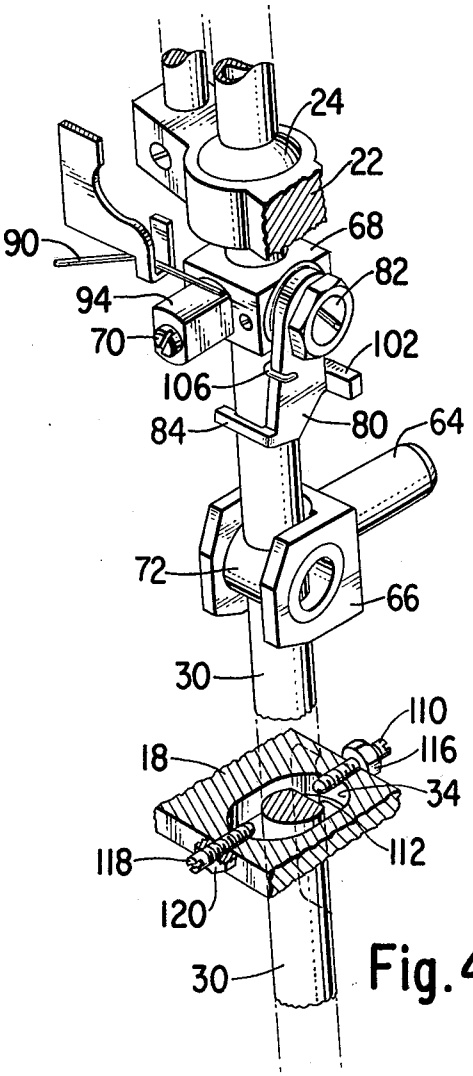
FIG. 4 is a fragmentary perspective view showing needle bar latch mechanism detached from needle reciprocating drive means.
Figure 3:
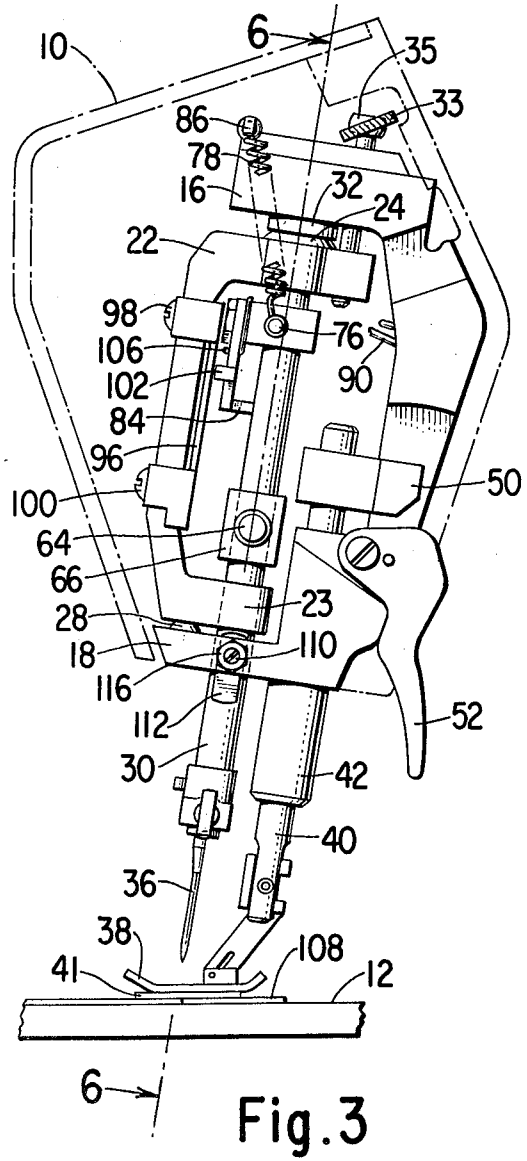
FIG. 3 is an elevational view of the head end portion of the machine as viewed from the interior of the machine in a direction opposite to that of FIG. 2.

Referring to the drawings, reference characters 10 and 12 designate the head end portion and a work supporting bed portion respectively of a skip stitch sewing machine. The head end portion includes a fixed support bracket 14 having an upper extending arm 16 and a lower extending arm 18 wherein a gate 20 is journalled. Gate 20 includes an upper rearwardly extending arm 22 and lower rearwardly extending arm 23. Inserted in the upper arm of the gate 20 is an upper bearing having an outer spherical surface 24 and a coaxial internal bearing surface. Inserted into the lower arm of the gate is a bearing 26 having both an internal bearing surface and spaced therefrom a socket. A spherical headed rivet 28 affixed to the lower arm 18 of the support bracket 14 has its spherical head protruding into the socket of the lower bearing.

A needle bar 30 is supported for endwise reciprocation by a rotating arm shaft 25 acting through a crank 27 and link 29. As shown, the needle bar 30 is supported in the internal bearing surface of the upper bearing in the upper arm of the gate 20 and in the internal bearing surface of the lower bearing in the lower arm of the gate. A socket bearing 32, having an internal clearance hole for the needle bar 30, is mounted in a bore in the upper arm 16 of the support bracket 14 and provides the socket for the outer spherical surface 24 of the upper bearing mounted in the upper arm 22 of gate 20. The needle bar 30 extends through an elongated opening 34 in the lower arm 18 of support bracket 14 which provides lateral clearance for the needle bar. The gate and needle bar are laterally movable by a link 33 on a needle bar post 35 in opposite directions for zig-zag sewing and to a position beyond their zig-zagging range for skip stitching. Link 33 may be operable by the cams or a cam stack as in the manner indicated in U.S. Pat. No. 3,559,601 mentioned hereinbefore, or by a servomotor as in the manner indicated in U.S. Pat. No. 3,984,745 of The Singer Company issued Oct. 5, 1976.

Attached to the lower end of the needle bar 30 is a needle 36 which cooperates with a loop taker (not shown) in the bed portion 12 of the machine. A presser foot 38, affixed to a pressure bar 40, serves to urge work material into contact with a feed dog 41. The presser bar is journalled in a bearing 42 which is affixed in a bore in the support bracket 14 by a screw 44. The upper end of the presser bar 40 has affixed thereto by a screw 46, a presser bar guide block 48. Such guide block 48 has a tang portion 50 slidable in a slot in the support bracket 14 to prevent undesirable rotation of the presser foot 38. The tang portion 50 of the presser guide block 48 also coacts with a presser bar lifting lever 52, journalled on the support bracket 14, to raise the presser foot from contact with the work material in the usual manner. Pressure exerted by the foot 38 on work material may be controlled by known pressure regulating means of the type shown and described, for example, in U.S. Pat. No. 3,793,969 of The Singer Company.

As shown, link 29 connects through a driving stud 64 with a drive link 66 which may be latched to or unlatched from a latch carrier block 68 that is affixed to the needle bar 30 by a screw 70. The drive link 66 includes a collar 72 freely slidable on the needle bar 30 when the drive link 66 is unlatched from the block 68. On the opposite side of block 68 from screw 70, a pin 76 is supported, protruding sufficiently to catch the hook end of an extension spring 78. On the forwardly disposed face of the block 68, a latch 80 pivots on a shouldered screw 82. The latch 80 is fashioned with a rearwardly directed latch finger 84 to extend beneath and clasp the drive link 66 to the block 68 affixed to the needle bar. A second hook end of the extension spring 78 is attached to a fixed member 86. The spring 78 serves to lift the latch carrier block 68 and needle bar 30 to an elevated position whenever the latch 80 is disengaged from link 66. A resilient abutment means 90 secured by a screw 92 to support bracket 14 and engageable with a toe 94 affixed to block 68 serves to limit the height to which the latch carrier and needle bar may be carried, and to thereby facilitate relatching of the needle bar to the endwise reciprocatory driving mechanism.

Figure 6:
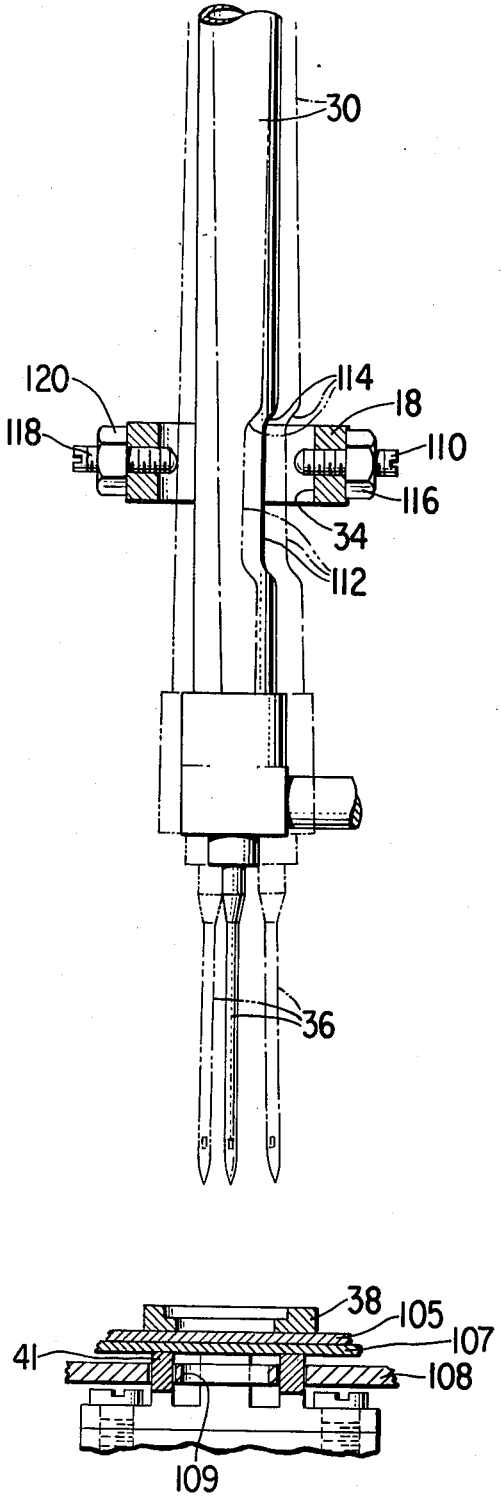
FIG. 6 is an enlarged fragmentary view taken on the plane of the line 6—6 of FIG. 3 and showing the spatial relationship between the needle bar of the machine when in an up position and the deflecting arrangement of the invention.
Figure 7:
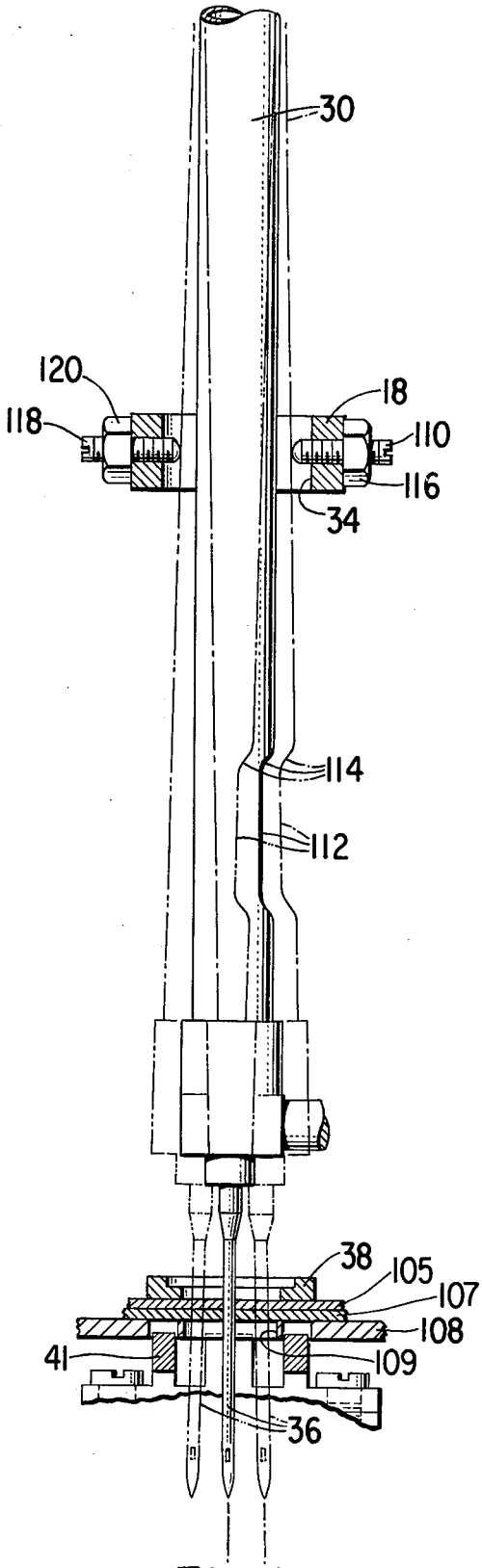
FIG. 7 is a view similar to FIG. 6 showing the needle bar in a down position.

Normally the drive link 66 is latched to block 68 and the needle bar is reciprocated by the associated driving means whether the needle bar is in a central straight stitching position (solid line position of FIGS. 6 and 7), or is oscillated for zig-zag stitching. However, gate 20 is provided with a latch release abutment member 96 as disclosed in the aforementioned U.S. Pat. No. 3,782,311 for disconnecting latch 80 and thereby the needle bar reciprocating drive from the needle bar whenever the needle bar 30 is moved by link 33 acting upon gate 20 into a skip stitch position for needle 36 (right side broken line position of FIG. 6).

The latch release abutment member 96 which is adjustably attached to the gate 20 by screws 98 and 100 extends adjacent a forwardly extending ear 102 on latch 80. As described in the said U.S. Pat. No. 3,782,311, when the gate is moved (to the left as viewed in FIG. 1), beyond a maximum bight position for needle 36 to a skip stitch position, abutment member 96 is disposed strike forwardly extending ear 102 on latch 80 moving to the right with the needle bar and uncouple the latch from the needle bar reciprocating drive thereby causing the needle to cease reciprocation. As contact between the abutment member 96 and forwardly extending ear 102 of the latch 80 is eliminated by movement of the gate to the right the latch is rotated by torsion spring 106. When the block 68 reaches the latch 80 held in the relatching position by spring 78, connection is again made to the needle bar reciprocating drive to initiate reciprocation of the needle bar.

Provision is made in accordance with the invention for preventing the needle bar 30 from moving needle 36 into an interferring relationship with presser foot 38 or a throat plate 108 in the event the unlatching of the latch 80 should fail to occur when the gate and needle bar are moved to a skip stitch position, due for example to a misadjustment of abutment member 96 on gate 20 or for any other reason. As shown, the lower arm 18 of fixed support bracket 14 is provided with a screw 110 extending into opening 34, and the needle bar 30 is provided with an elongated cut-out portion 112 which in the up position of the needle bar lies opposite the screw 110. When the needle bar is caused to assume the skip stitch position, it is so disposed as to cause the screw 110 to extend into the needle bar cut-out. If the needle bar is then moved downwardly by the needle bar reciprocating drive because the unlatching mechanism fails to operate, the screw 110 is caused to engage a camming surface 114 on the cut-out portion 112 of the needle bar, and the needle bar is cammed leftward sufficiently to permit the needle bar to descend to its lowest position (right-side broken line position of FIG. 7) into throat plate aperture 109 to sew material 105 and 107 without striking the presser foot 38 or throat plate 108. The screw 110 is adjustable with respect to the cut-out portion 112 of the needle bar 30 and is securable in its adjusted position with a nut 116.

A second screw 118 is preferably provided in lower arm 18 of fixed support bracket 14 in alignment with screw 110, and caused to extend into opening 34 to a position wherein it serves, during zig-zag stitching, to prevent any abnormal leftward movement (as viewed in FIGS. 6 and 7) of the needle bar causing the needle when descending to strike the presser foot or throat plate. Uncontrolled leftward movement of the needle bar brings the needle bar into engagement with screw 118 and the needle bar position is limited thereby to the broken line leftward position of FIGS. 6 and 7 permitting the descending needle to clear the presser foot and throat plate as shown. Screw 118 is adjustable in the manner of screw 110 and is securable in its adjusted position with nut 120. Of course, any uncontrolled rightward movement of the needle bar during zig-zag stitching is limited by screw 110 and the needle bar is prevented by the screw from moving the needle into an interferring relationship with the presser foot or needle bar.

It is to be understood that the present disclosure relates to a preferred embodiment of the invention which is for purposes of illustration only and is not to be construed as a limitation of the invention. Numerous alterations and modifications of the structure herein disclosed will suggest themselves to those skilled in the art, and all such modifications and alterations which do not depart from the spirit and scope of the invention are intended to be included within the scope of the appended claims.

We claim:

1. In a sewing machine, a needle bar, a gate supporting the needle bar for endwise reciprocation, latching means carried on the needle bar, actuating means for imparting endwise reciprocatory motion to the needle bar through said latching means, means for laterally jogging the gate and thereby the needle bar for zig-zag sewing and for moving the needle bar in one direction into a skip stitch position, means for unlatching the latching means from said actuating means in the skip stitch position of the needle bar, a cam surface on the needle bar, and means mounted in the machine to engage said cam surface in the event the unlatching means fails to operate and to thereby urge the needle bar in a direction opposite to said one direction to prevent the needle bar from moving a needle affixed thereto into an interferring relationship with a presser foot or throat plate.

2. The combination of claim 1 wherein a cut-out portion of the needle bar includes said cam surface.

3. The combination of claim 1 wherein the means to engage said cam surface is adjustable.

4. The combination of claim 3 wherein the means to engage the cam surface is a screw.

5. The combination of claim 4 wherein the cam surface and screw are engageable between the gate and a work supporting bed.

6. The combination of claim 1 including means engageable with the needle bar for limiting motion of the needle bar in said opposite direction to prevent the needle from being moved by the needle bar into an interferring relationship with the presser foot or throat plate.

7. The combination of claim 6 wherein the means engageable with the needle bar for limiting motion of the needle bar in said opposite direction is adjustable.

8. The combination of claim 6 wherein the means engageable with the needle bar for limiting motion of the needle bar in said opposite direction is a screw.

9. The combination of claim 8 wherein the means to engage the cam surface is a screw in alignment with the screw for limiting motion of the needle bar in the said opposite direction.

* * * * *